United States Patent [19]

Howard et al.

[11] 3,986,579

[45] Oct. 19, 1976

[54] STAIRWAY CONSTRUCTION

[76] Inventors: James L. Howard, 4799 Oak Twig Way, Carmichael, Calif. 95608; Daniel D. Howard, 1648 La Playa Way, Sacramento, Calif. 95825

[22] Filed: Aug. 18, 1975

[21] Appl. No.: 605,612

[52] U.S. Cl. ..... 182/189; 182/217; 182/220; 52/189

[51] Int. Cl.[2] ..... E04F 11/00

[58] Field of Search ..... 182/194, 228, 189, 100, 182/220, 217; 52/182, 183, 187, 189

[56] References Cited

UNITED STATES PATENTS

| | | | |
|---|---|---|---|
| 3,216,160 | 11/1965 | Best | 52/189 |
| 3,667,572 | 6/1972 | Anderson | 52/182 |
| 3,747,709 | 7/1973 | Ridenour | 52/182 |

FOREIGN PATENTS OR APPLICATIONS

| | | | |
|---|---|---|---|
| 970,212 | 6/1950 | France | 52/189 |
| 837,595 | 4/1952 | Germany | 52/189 |
| 245,147 | 3/1912 | Germany | 52/189 |

*Primary Examiner*—Reinaldo P. Machado
*Attorney, Agent, or Firm*—Lothrop & West

[57] ABSTRACT

An inclined pair of stringer beams carries a plurality of transverse steps supported on saddles secured to the stringers. The upper tread surfaces of the steps are planar whereas the lower surfaces are arcuate, with a predetermined radius of curvature matching the corresponding arcuate shape of the subjacent supporting saddles.

By angularly tipping each of the steps to or fro in the respective pair of saddles, the upper tread surface of the steps can be leveled despite variations in the angle of inclination of the stringers.

The step is ordinarily constructed of precast concrete and includes metal reinforcements as well as metal inserts affording anchor points for attachment to the saddle, as by threaded fastenings or by welding.

5 Claims, 4 Drawing Figures

STAIRWAY CONSTRUCTION

BACKGROUND OF THE DISCLOSURE

U.S. Pat. Nos. 3,216,160 to H. A. Best and 3,667,572 to C. E. Anderson disclose means for mounting a stair in level attitude on a pair of stringer beams sloping at varying angles to the horizontal.

Still other forms of tread supporting assemblies appear in the patent literature and are also obtainable in the market place.

Despite the availability of such devices, however, there is considerable room for improvement.

SUMMARY OF THE INVENTION

The invention relates to a system for leveling the individual steps on a stairway despite variations in the slope of the supporting stringer beams.

It is an object of the invention to provide a stairway construction which is relatively light in weight and neat in appearance, and which can be quickly and accurately installed at the jobsite even by relatively unskilled personnel.

It is another object of the invention to provide a stairway construction which is relatively economical to make and install yet is durable and trouble free in use.

It is still another object of the invention to provide a generally improved stairway construction.

Other objects, together with the foregoing are attained in the embodiment described in the following description and illustrated in the accompanying drawing.

SHORT DESCRIPTION OF THE DRAWING

DETAILED DESCRIPTION OF PREFERRED EMBODIMENT

Figure 1:
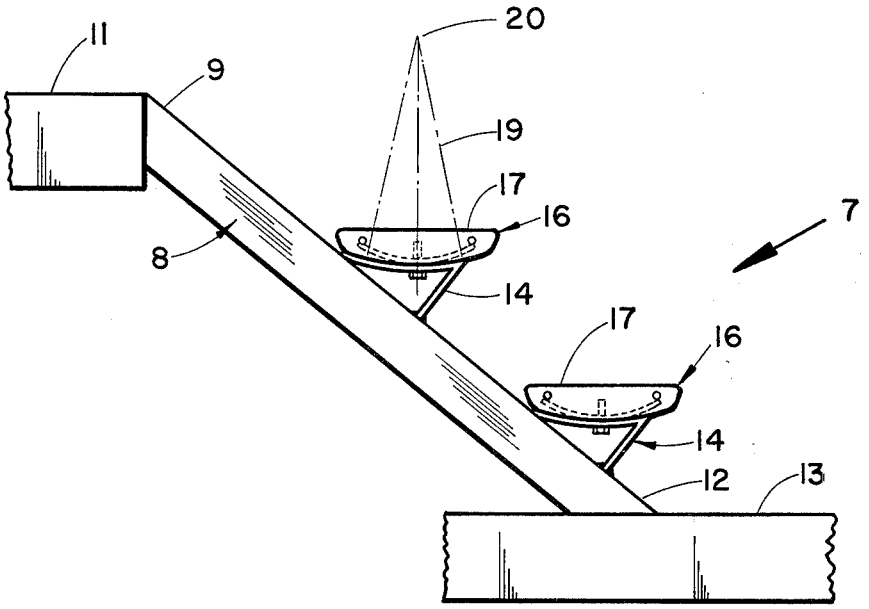
FIG. 1 is a fragmentary side elevational view.
Figure 2:
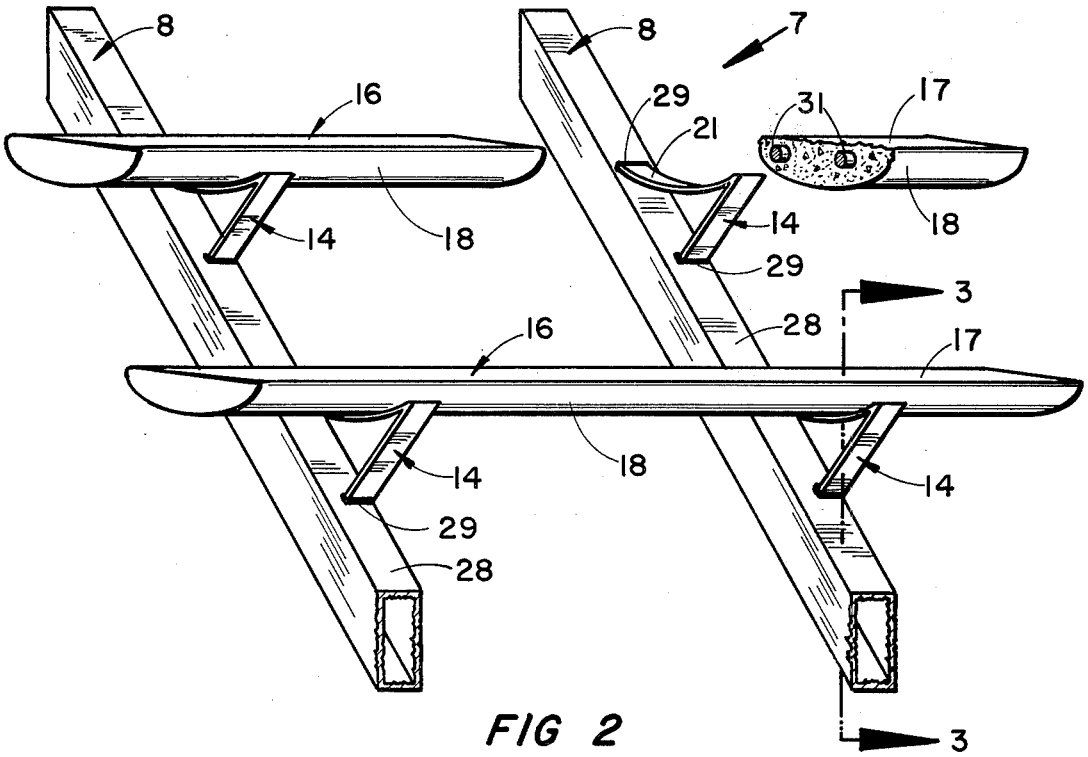
FIG. 2 is a fragmentary front perspective view, with portions broken away to reveal underlying structure.
Figure 3:
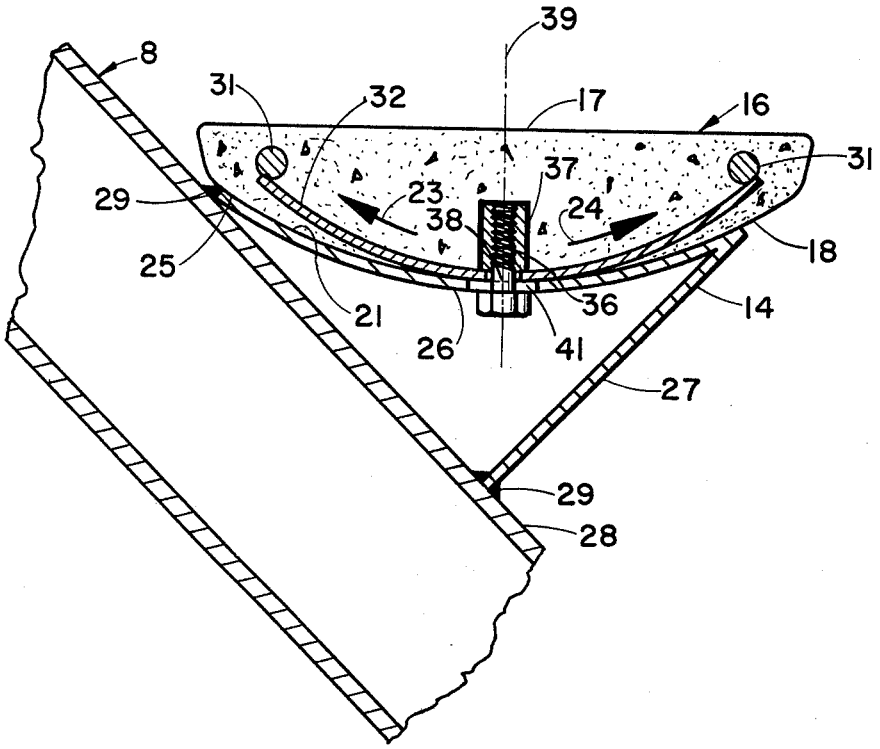
FIG. 3 is a sectional view, to an enlarged scale, the plane of the section being indicated by the line 3—3 in FIG. 2; and, FIG. 4 is a fragmentary front perspective of a step, to an enlarged scale, showing the precast concrete portion of the step in phantom in order more clearly to reveal the metal structure embedded in the step.
Figure 4:
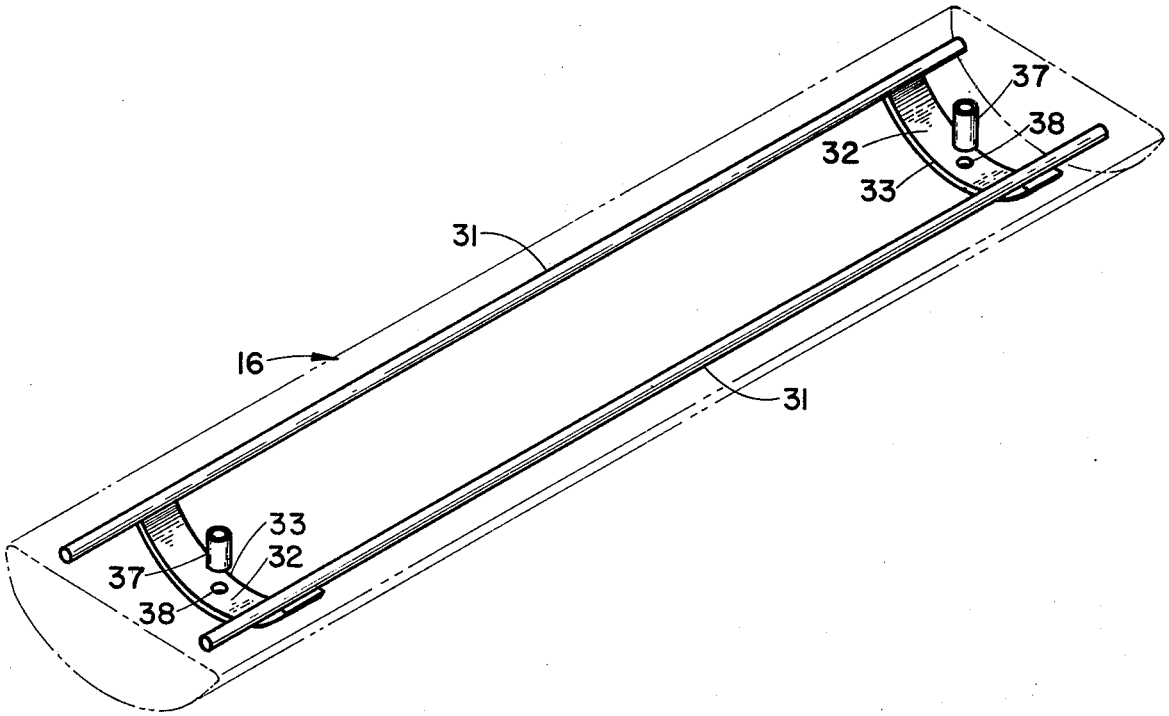

The stairway construction of the invention, generally designated by the reference numeral 7, includes three major components; namely, a pair of stringer beams 8 sloping downwardly from an upper end 9, located at an upper elevation 11, to a lower end 12, located at a lower elevation 13; a plurality of pairs of saddles 14, mounted at intervals along the stringers 8; and a plurality of transverse steps 16 spanning and being supported by respective pairs of saddles 14.

As will be apparent, the slope, or angle of inclination, of a given set of stringers 8 in any installation will vary in dependence upon the length of the stringers 8 and the height between elevations 11 and 13. It is equally obvious that despite the slope of the stairway, the planar, upper tread surface 17 of each of the steps 16 must be level, i.e. horizontal, in installed position.

Since economies can be effected by permanently mounting the saddles 14 on the stringers 8 at a central manufacturing location, it is advantageous to be able accurately to level the steps at the jobsite after the stringers and attendant saddles have been installed between the floors 11 and 13.

In order to facilitate the leveling of the steps regardless of the slope (within limits) of the stringers, the lower, downwardly facing surface 18 of the precast step 16 is molded to an arcuate configuration with a predetermined radius of curvature 19 having a center of curvature 20 (see FIG. 1). The arcuate lower surface 18 of the step 16 is supported on the arcuate upwardly facing surface 21 of the saddle 14. The saddle 14 is usually fabricated either from metal plate or metal strap material mounted on the respective stringer 8. The stringer, in turn, is frequently a hollow box beam channel or I-beam.

The arcuate upwardly facing surface 21 of the saddle 22 partakes of substantially the same radius of curvature 19 as the lower arcuate surface 18 of the step 16, thereby affording a snug engagement between the two surfaces over a rather extended distance and precluding any tendency of the step to rock relative to the saddle.

After the stringers and accompanying saddles have been installed, the individual steps 16 are placed on their respective pairs of saddles 14 and each step is thereupon leveled by tipping, or rotating, the step relative to the underlying saddle 14 until a bubble level located on the tread surface 17 indicates that the planar tread 17 is horizontal. The tipping, or rotating, motion of the step is indicated by the angular directional arrows 23 and 24, and the center of rotation of the step is the imaginary center 20 of the radius of curvature 19.

When the tread surface 17 has been leveled, the step is anchored to the subjacent saddle.

In one form of saddle, metal strap material is cut to length and bent to provide an arcuate cradle 26 of predetermined radius 19, as previously described. The after end 25 of the cradle 26 and a supporting leg 27 are secured to the upper surface 28 of the stringer 8 as by welding 29, riveting, bolting, or the like.

It is to be noted that in the preferred embodiment, the arcuate lower surface 18 of the step is downwardly convex and the mating arcuate upper surface 21 of the saddle is downwardly concave.

A reversal of these concavo-convex members is also possible. That is to say, if desired, the lower surface of the step 16 can be made upwardly concave in section to match an upwardly convex saddle 14.

So also, it is to be realized, that the external configuration of the step, in all aspects save the interface between the step and cradle, is susceptible of numerous variations in shapes and sizes. At the interface, however, a snug concavo-convex relationship preferably obtains, as previously explained.

In some installations, the saddle 14 is constructed of metal plate material rather than metal strap. In this event, the plate is generally triangular in shape with the base of the triangle secured, as by welding, to the top surface 28 of the stringer. The upper side, or cradle 26, of the triangular plate is formed with a predetermined radius of curvature, as in the case of the formed strap.

In order to provide additional strength, the precast concrete steps 16 are reinforced by a pair of parallel bars 31 located adjacent the long margins of the steps. Connecting each of the reinforcing bars 31 is a pair of U-shaped mounting straps 32 of metal material. At the lowest point 33, the straps 32 are exposed at the bottom surface of the step in order to provide a metal to metal contact with the subjacent metal stringer 8, thereby enabling the step to be affixed to the stringer as by welding, if desired.

In many installations it is preferred to use threaded fastening members, such as bolts 36, or machine screws, in order to affix the steps 16 to the saddles 14.

In these instances, the precast concrete steps are provided with a pair of interiorly threaded sleeves 37 embedded within the step in radial orientation relative to the arcuate lower surface 18 of the step.

In this form of device, the lowest point 33 of the U-shaped strap 32 has an opening 38 formed therein, in register with the sleeve axis 39 to receive the threaded end of the bolt 36.

An elongated slot 41 is formed in the cradle 26. Thus, during installation, when the step is being tipped, or tilted, or rotated, to or fro about the center of the radius of curvature 19 to make the tread surface 17 level, the bolt 36 can readily be inserted through the slot 41 into threaded engagement with the registering radial, interiorly threaded sleeve 37 and then tightened so as to secure the step in the desired horizontal attitude.

It can therefore be seen that we have provided a stairway construction which is both economical and versatile in that costs and services can be minimized by doing much of the work at the factory, or other central location, and by effecting final installation in a quick and expeditious manner despite variations in the slope of the stairway.

What is claimed is:

1. Stairway construction comprising:

a. a stringer beam sloping from an upper end to a lower end;

b. an elongated transverse step carried by said beam, said step including a planar upper tread surface and an arcuate lower surface having a predetermined radius of curvature, said step further including a spaced pair of reinforcing bars extending longitudinally within said step adjacent the longitudinal margins thereof, and a U-shaped metal strap spanning said bars with the bottom of said strap substantially coincident with the bottom portion of said arcuate lower surface of said step;

c. a step-supporting saddle of metal material fixedly mounted on said stringer, said saddle including an arcuate upper surface having a radius of curvature similar to said predetermined radius of curvature for snug engagement between said step and said saddle as said step is tilted to and fro in a fore and aft direction relative to said saddle in order to level said tread surface of said step; and, d. means for securing said step to said saddle in leveled position of said tread surface.

2. Stairway construction as in claim 1 in which said bottom of said metal strip is exposed to the subjacent metal surface of said saddle and in which said securing means includes a weldment joining the metal surfaces of said strap and said saddle in face to face engagement.

3. Stairway construction as in claim 1 in which said bottom of said metal strap is exposed to the subjacent metal surface of said saddle and in which said securing means includes a threaded fastener.

4. Stairway construction as in claim 3 further including an interiorly threaded sleeve embedded within said step in radial relation to said arcuate lower surfaces of said step and said saddle, said saddle having an elongated fore and aft slot to receive said threaded fastener passing through said slot and into threaded engagement with said radial sleeve throughout a predetermined range of fore and aft tilting movements of said step in leveling said tread surface.

5. Stairway construction as in claim 1 including at least two of said stringer beams in spaced parallel relation; and a plurality of said steps spanning said stringer beams.

* * * * *